United States Patent [19]

Love, Sr.

[11] 3,971,240

[45] July 27, 1976

[54] LOCKING COVER FOR TELEVISION CONTROLS

[76] Inventor: John A. Love, Sr., 30 Somerset St., Battle Creek, Mich. 49017

[22] Filed: June 22, 1971

[21] Appl. No.: 155,559

[52] U.S. Cl. ..... 70/160; 70/212; 178/7.9; 312/7 TV

[51] Int. Cl.[2] ..... B65D 55/14

[58] Field of Search ..... 70/158, 159, 160, DIG. 34, 70/41, 211, 212; 312/7 TV, 138, 215; 178/7.9

[56] References Cited

UNITED STATES PATENTS

| | | | |
|---|---|---|---|
| 2,543,146 | 2/1951 | Bace | 312/7 TV |
| 2,598,072 | 5/1952 | Rose | 312/7 TV |
| 3,096,409 | 7/1963 | Hubbell et al. | 200/44 |

FOREIGN PATENTS OR APPLICATIONS

| | | | |
|---|---|---|---|
| 1,442,147 | 5/1966 | France | 70/160 |

OTHER PUBLICATIONS

Radio & Television Retailing, Feb. 1950, p. 54.

Ellis, Science & Mechanics, vol. 36, No. 3, Mar. 1965, p. 82.

*Primary Examiner*—Roy D. Frazier
*Assistant Examiner*—Lawrence J. Staab

[57] ABSTRACT

A locking cover is provided which is mounted at one edge on a television set and so arranged when in locked position that all the primary television controls are covered and unaccessible to the hand, and which when unlocked, may be swung or slid to a position where access to the primary controls is provided. The device is further characterized in that when in locked position, it does not substantially interfere with sound coming from the loudspeaker aperture of the television set and does not cover the picture tube. The cover may be locked in place with any conventional type of lock and key such as a pin tumbler lock or a padlock, and may be unlocked by a key, combination arrangement or any other suitable lock.

1 Claim, 7 Drawing Figures

FIG. 1
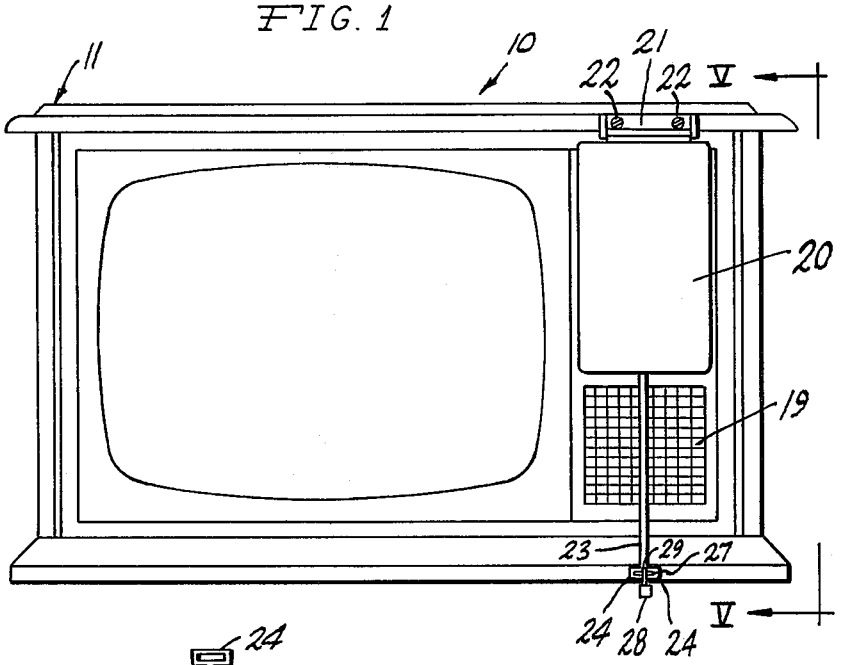
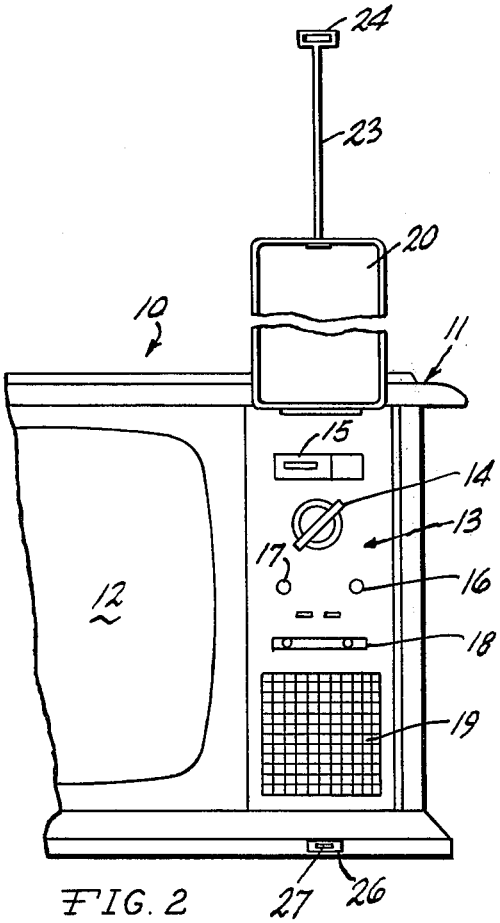
FIG. 2
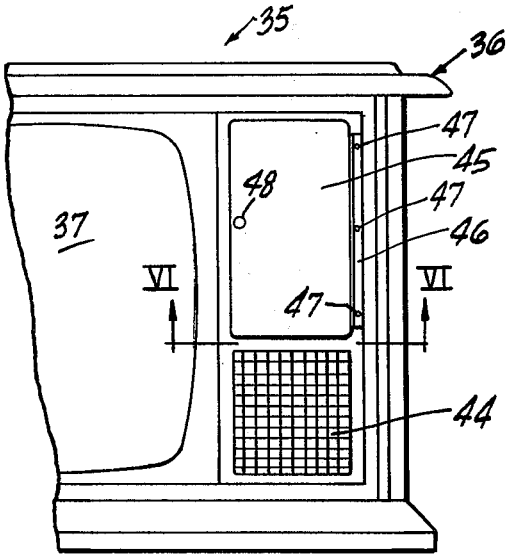
FIG. 3
INVENTOR
JOHN A. LOVE, SR.
BY Plant and Kurlandsky

INVENTOR
JOHN A. LOVE, SR.

BY Plant and Kurlandsky

ATTORNEYS

LOCKING COVER FOR TELEVISION CONTROLS

BACKGROUND OF THE INVENTION

The matter of controlling the operation of a television set frequently becomes important, particularly when children have access to the set. At times it is desirable to render the primary controls of the set, that is, the channel selector, fine tuning, volume control, and on-off switch with the on-off switch in the off position so that the television may not be operated at all. At other times, as for example when the parents are going to be away from home and the children attended by babysitters or neighborhood children, it may be desirable to leave the television set in the operating state tuned to a particular channel and at a particular volume, but where those in attendance are prevented from changing the channel selector or re-adjusting the television set in any manner.

SUMMARY OF THE INVENTION

Accordingly, it is an object of the present invention to provide a protective cover for the primary controls of a television set which may be locked in place so that persons not having access to the key or other opening device are not able to operate the television.

It is a further object to provide a locking cover for a television set which may be locked in place while the set is turned on and which will not interfere with the proper operation of the set.

It is a further object to provide a protective cover of the type described which is adapted to be utilized with television sets having various placements of primary controls and loudspeakers and their apertures or ports.

It is still further an object to provide a locking cover for a television set which does not detract from the appearance of the set either in the locked or unlocked positions.

It is still further an object to provide a locking cover of the type described which is relatively inexpensive and relatively simple to assemble and to mount on a television set.

Still further objects and advantages of the invention will appear as the description proceeds.

To the accomplishment of the foregoing and related ends, the invention, then, consists of the useful locking cover for the primary controls of a television herein fully described and particularly pointed out in the claims, the annexed drawings and the following description setting forth in detail certain illustrative embodiments of the invention, such disclosed embodiments illustrating, however, but several of the various ways in which the principle of the invention may be used.

BRIEF DESCRIPTION OF THE DRAWINGS

FIG. 1 is a front elevation of a television set having a locking cover according to the present invention mounted thereon, showing the cover in locked position.

FIG. 2 is a fragmentary front elevational view of the television set shown in FIG. 1 with the locking cover in open position.

FIG. 3 is a fragmentary front elevational view of a television set similar to that of FIG. 1, but having a locking cover constituting another embodiment of the invention.

DESCRIPTION OF THE SPECIFIC EMBODIMENTS

Figure 4:
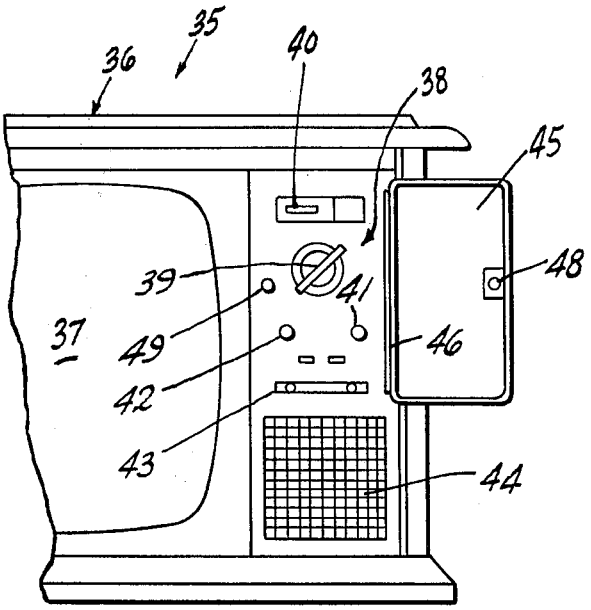
FIG. 4 is a fragmentary elevational view similar to that of FIG. 3, but with the cover in open position.
Figure 5:
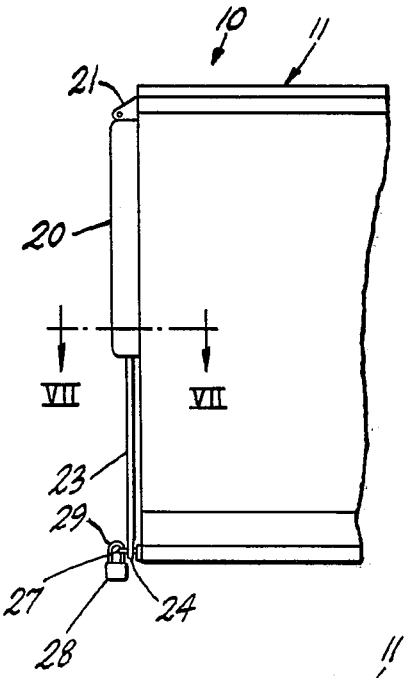
FIG. 5 is an end view taken at the line V—V of FIG. 1, looking in the direction of the arrows.

Referring more particularly to FIGS. 1, 2, 5 and 7, one embodiment of the invention is shown comprising a television set 10 having a cabinet 11, a picture tube screen 12, and a primary control panel 13, shown in FIG. 2. The control panel 13 comprises a plurality of control dials and knobs, including a channel selector switch 14 having fine tuning adjustment associated therewith, a channel indicator 15, a combined volume control and on-off switch 16, a tone control 17, and color adjusting controls 18 (where a color television is involved). Below the control panel 13 is a loudspeaker port or louver 19. A locking panel or cover 20 is hingedly mounted on the cabinet 11 by means of a hinge 21 affixed to the cabinet 11 by means of screws 22. An extension rod 23 is affixed at one end to the lower edge of the locking cover 20 and at the other end it is provided with a lateral slot member 24. A base 26 having a hasp 27 is mounted at the base of the cabinet 11 and so positioned that the hasp 27 is engaged by the lateral slot member 24 when the cover 20 is in closed position, as shown in FIG. 1. The cover 20 is locked in place by means of a padlock 28 having a shackle 29 which engages the hasp 27 thereby locking the cover panel in place.

The embodiment of FIGS. 1, 2, 5 and 7 may be locked in place over the controls either when the television is on or when it is off. That is, the cover and locking means have a structural configuration effective to allow the television set to be left in an asperating condition while the cover is in the closed and locked position. In either case it prevents manipulation of the primary controls by unauthorized personnel such as children who might be left alone in a house. However, if the cover is locked in place while the television is on and tuned to a particular channel, persons present may listen to the selected channel, but may not select another channel or in any other manner change the settings of the controls. Use of the television set while in locked condition is facilitated by the fact that the extension rod 23 is small in diameter and does not in any way block or attenuate the sound emanating from the loudspeaker port 19.

Figure 6:
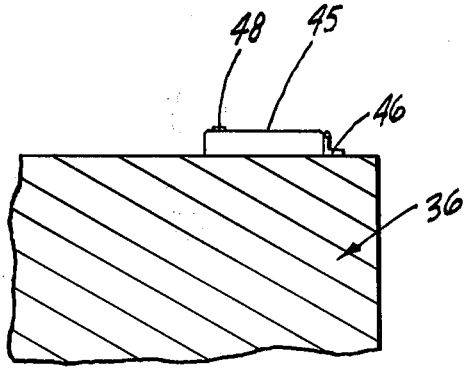
FIG. 6 is a fragmentary cross-sectional view taken at the line VI—VI of FIG. 3, looking in the direction of the arrows.
Figure 7:
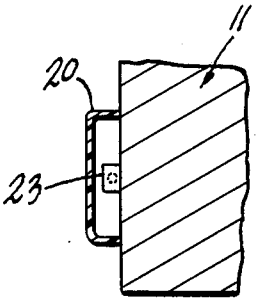
FIG. 7 is a fragmentary cross-sectional view taken at the line VII—VII of FIG. 5, looking in the direction of the arrows.

Referring to FIGS. 3, 4 and 6, another embodiment of the invention is shown comprising a television set 35 having a cabinet 36, picture tube screen 37, and control panel 38, shown in FIG. 4. The control panel 38 comprises a channel selector switch having means for fine tuning 39, channel indicator 40, combination volume control and on-off switch 41, tone control 42, and color controls 43 (where a color television is involved). A loudspeaker port or louver 44 is positioned below the control panel 38. A locking cover or panel 45 is hingedly mounted along its outer vertical edge by means of a hinge 46 affixed to the cabinet 36 by means of screws 47, FIG. 3. A cylinder lock 48 is mounted near the free vertical edge of the cover 45 and arranged to engage a latch 49, FIG. 4, when in the locked position.

The cover 45 may be utilized in the same manner as the cover 20 described above. It may be locked in place over the controls by means of the lock 48 while the on-off switch 41 is in the off position. Alternatively, the television set may be turned on and a channel selected and the picture and sound adjusted for normal listening. The cover 45 may then be locked in place by means of the lock 48. Persons such as children may then continue to watch the television without being able to manipulate any of the primary controls. The cover 45 is designed and so positioned that although it covers the primary controls, it does not extend over the loudspeaker port, and therefore does not interfere with or attentuate sound emanating from the loudspeaker.

Although the embodiments shown in the drawings and described utilize a cover which is hingedly mounted at one edge to the cabinet, covers mounted in other ways may also be utilized and are to be considered as embodiments of the present invention. For example, the cover may slide in a suitable support such as a track. Alternatively, the cover may be formed of articulated strips and guided in grooves or tracks at the ends thereof provided in a support mounted on the cabinet. Covers having many other forms of mounting may also be utilized.

The present invention has many advantages. It may be used to cover the primary television controls and locked in place so that no one not having access to the key may manipulate the controls either to turn the set on or off or to change the channel selected. Its locking mechanism is so designed that it does not interfere with the normal functions of the loudspeaker. Consequently, the cover may be locked in place while the television is on and turned to the desired channel so that persons may continue to listen to and watch the television without deterioration or attenuation of the sound thereof. The cover and its locking mechanism may be provided in any of several embodiments and will adequately perform in each embodiment. As is evident in the drawings and the disclosure herein, the primary control cover and locking means constitute a unit that is mountable on a television set. The cover may be suitably mounted and hinged at any convenient edge, so that it can be swung away from the control panel and to a position where it does not interfere with normal operation of the television set nor with persons passing near the television set. In the embodiments utilizing a sliding cover, the cover may be designed to slide into a position below or to one side of the controls where it may remain in a position in which it does not interfere with the proper operation of the set, and may even be designed so that it disappears into a receptacle or slot when the primary controls are uncovered. When appropriate, the device may also be used in combination with radios and phonographs.

While but only several forms of the invention have been shown and described, other forms will now be apparent to those skilled in the art. Therefore, the embodiments shown in the drawings are merely for illustrative purposes, and are not intended to limit the spirit and scope of the invention as above described and illustrated in the drawings.

Other modes of applying the principle of my invention may be employed, instead of the ones explained, change being made as regards the apparatus herein disclosed, provided the features stated by any of the following claims or the equivalent of such stated features be employed.

I therefore particularly point out and distinctly claim as my invention:

1. In combination with a television set having a cabinet containing an electrical chassis, a picture tube, primary television controls exteriorly accessible, a loudspeaker and a loudspeaker port:

a a primary control cover hingedly mounted at one edge of said cabinet and arranged alternatively to expose said primary controls including an on-off switch and a channel selector switch or to cover all the primary controls, and b locking means for locking the cover in place over the controls thereby preventing manipulation of the controls while the cover is in a closed and locked position, c said cover and said locking means being so arranged that sound emanating from the loudspeaker port is not adversely affected or attenuated, d said locking means comprising a rod extending across said loudspeaker port and having one end affixed to said cover and having a slot provided at the other end thereof, hasp means mounted on said cabinet adapted to be engaged by said slot when said cover is in closed position and padlock means having a shackle adapted to extend through said hasp and to be locked in place.

* * * * *